United States Patent [19]

Thatcher et al.

[11] Patent Number: 4,646,649

[45] Date of Patent: Mar. 3, 1987

[54] DRIVERLESS VEHICLE WITH FLOATING MOUNTED SUBSTRATE, AND PRECISION STOP/LOCATOR ASSEMBLY

[75] Inventors: James L. Thatcher, Alpha, N.J.; Per E. Lindquist, Easton, Pa.

[73] Assignee: SI Handling Systems, Inc., Easton, Pa.

[21] Appl. No.: 610,731

[22] Filed: May 15, 1984

[51] Int. Cl.[4] ..... B61B 13/12; B60P 9/00

[52] U.S. Cl. ..... 104/166; 104/252; 198/345

[58] Field of Search ..... 104/165, 166, 250, 1, 104/287, 47, 249, 250, 252; 414/749, 750; 198/345, 648, 803.01

[56] References Cited

U.S. PATENT DOCUMENTS

| | | | |
|---|---|---|---|
| 3,343,645 | 9/1967 | Doerfling | 198/345 |
| 3,861,322 | 1/1975 | Danly | 104/287 X |
| 4,049,500 | 9/1977 | Kamm | 198/345 |
| 4,054,215 | 10/1977 | Kurahashi | 104/166 X |
| 4,201,284 | 5/1980 | Brems | 198/345 |
| 4,357,876 | 11/1982 | Nobel | 104/166 |
| 4,390,172 | 6/1983 | Gotman | 198/345 X |
| 4,428,300 | 1/1984 | Ziegenfus et al. | 104/166 X |
| 4,461,215 | 7/1984 | Sims | 414/750 X |
| 4,515,084 | 5/1985 | Jacoby | 104/166 |
| 4,538,950 | 9/1985 | Shiomi et al. | 104/1 R X |
| 4,553,311 | 11/1985 | Medico | 198/345 X |

FOREIGN PATENT DOCUMENTS

| | | | |
|---|---|---|---|
| 1158546 | 4/1961 | Fed. Rep. of Germany | 104/47 |

*Primary Examiner*—Robert B. Reeves
*Assistant Examiner*—Scott H. Werny
*Attorney, Agent, or Firm*—Seidel, Gonda, Goldhammer & Abbott

[57] ABSTRACT

A driverless vehicle, propelled by a longitudinal drive shaft, is provided with a load supporting substrate coupled to the vehicle body by a floating mount which permits the substrate to be moved relative to the body in a limited manner. A precision locator for use with said vehicle orientates the substrate in three directions, namely fore-aft, transversely, and vertically.

15 Claims, 6 Drawing Figures

FIG. 1
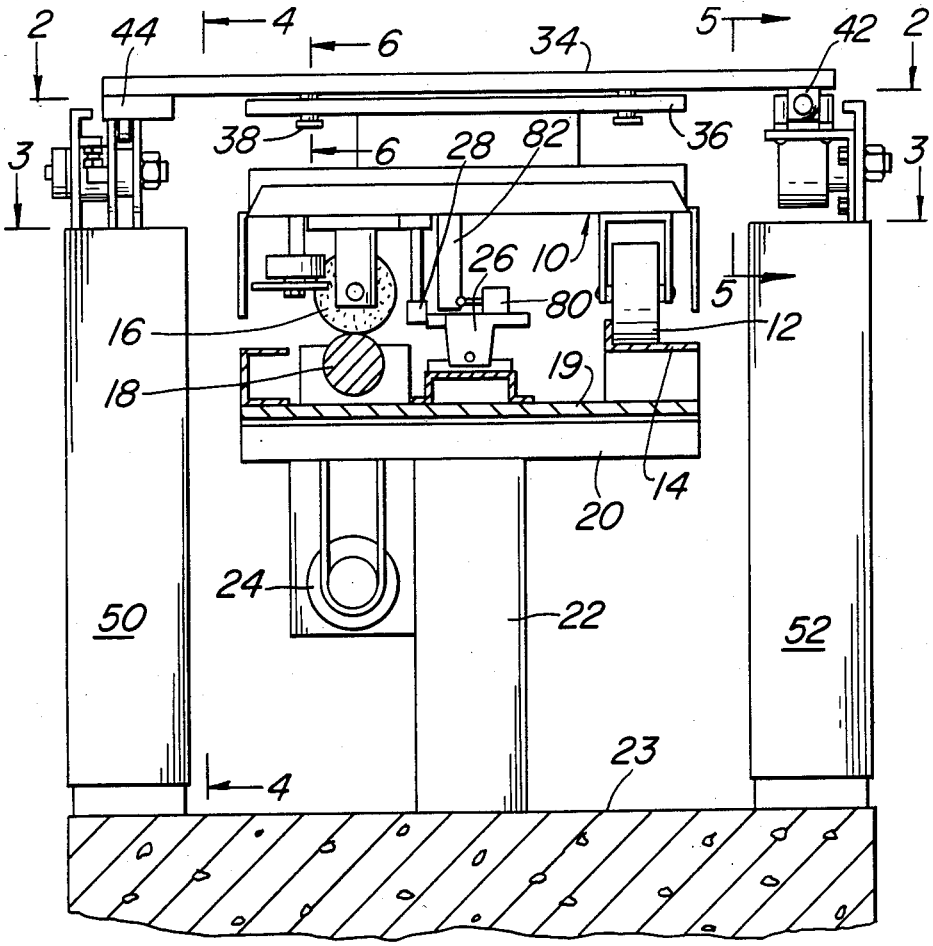
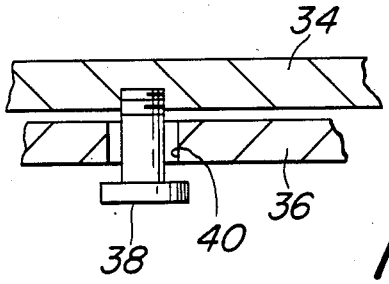
FIG. 6

FIG. 4
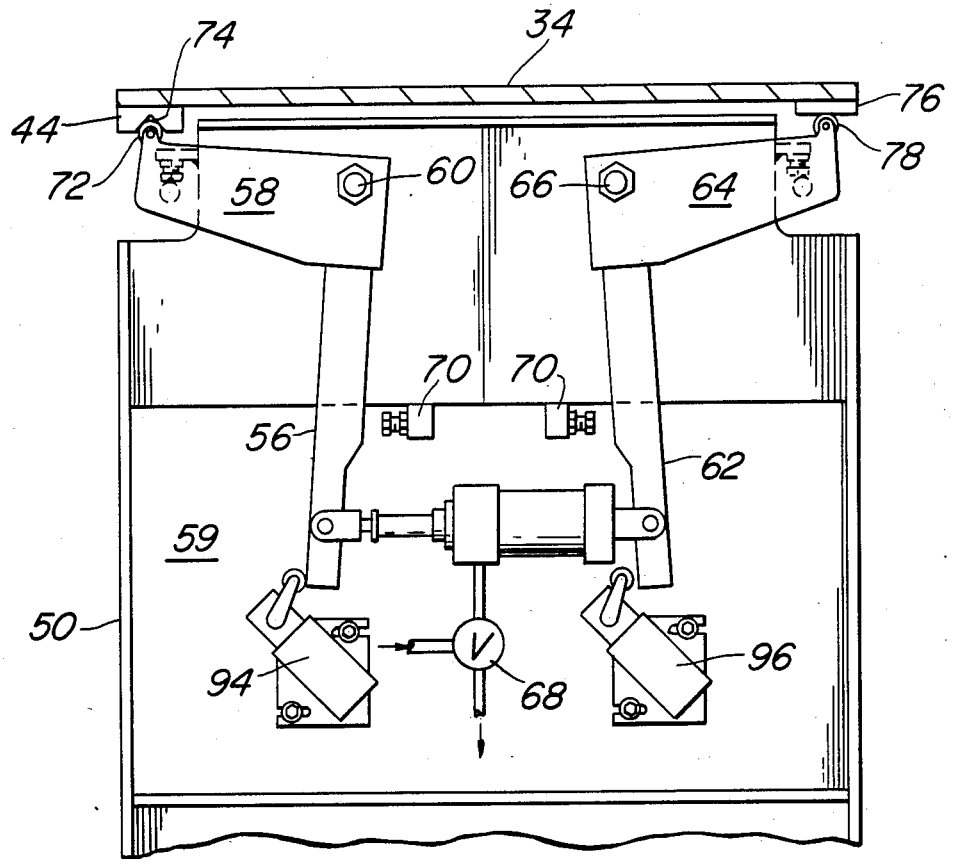
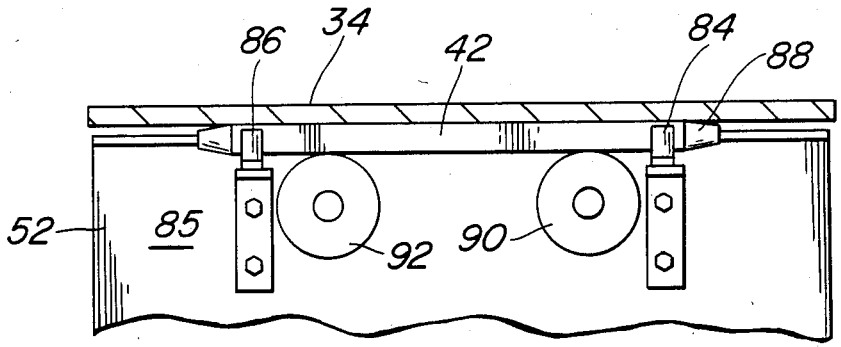
FIG. 5

DRIVERLESS VEHICLE WITH FLOATING MOUNTED SUBSTRATE, AND PRECISION STOP/LOCATOR ASSEMBLY

BACKGROUND OF THE INVENTION

Driverless vehicles of the general type involved herein are per se known. The present invention is directed to solution of the following problem. The problem is how to orientate a vehicle in three directions including a vertical direction without elevating the vehicle body with respect to a track for the body. The problem must be solved in a manner which is simple and reliable while providing for extreme precision within a tolerance such as plus or minus 0.005 inches (0.125 mm).

SUMMARY OF THE INVENTION

The present invention is directed to a driverless vehicle wherein support wheels for a body are adapted to ride on a track. The body has at least one drive wheel adapted for frictional contact with a drive shaft. The body has a load supporting substrate coupled to the body by a floating mount which permits the substrate to be elevated relative to the body. The substrate is provided with a position locator means for cooperation with a locator off the vehicle when positioning a parameter of the substrate.

The present invention also includes a system involving a driverless vehicle and a precision locator. The vehicle may be as described above. The precision locator includes a frame having first and second portions on opposite sides of a track. The first frame portion has roller means for elevating one side of a portion of the vehicle body such as the substrate. The second frame portion has motor means for elevating the opposite side of said portion of the vehicle so that it is horizontally disposed. The frame includes means for positioning the vehicle portion in a pre-determined fore-aft location with precision and means for causing a driverless vehicle to stop between said first and second frame portions.

It is an object of the present invention to provide a driverless vehicle and system involving said vehicle which provides for precision adjustment of a portion of the vehicle in a vertical direction without elevating the vehicle body.

It is another object of the present invention to provide a driverless vehicle having novel structure thereon to facilitate precision adjustment in a transverse direction as well as in a fore-aft direction.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a sectional view of a system in accordance with the present invention looking in the direction from whence the vehicle comes.

FIG. 4 is a sectional view taken along the line 4—4 in FIG. 1.

FIG. 5 is a sectional view taken along the line 5—5 in FIG. 1.

FIG. 6 is a sectional view taken along the line 6—6 in FIG. 1.

DETAILED DESCRIPTION

Figure 3:
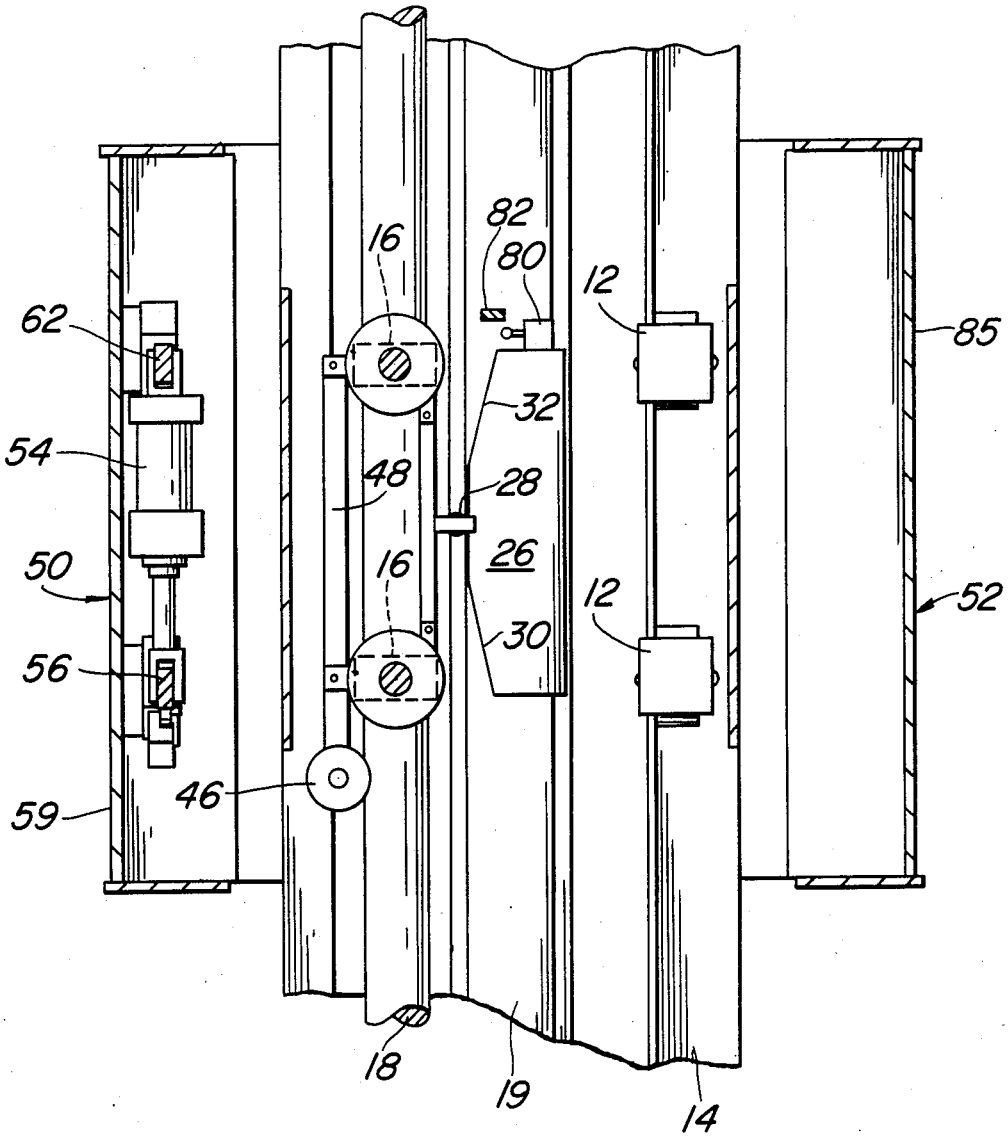
FIG. 3 is a sectional view taken along the line 3—3 in FIG. 1.

Referring to the drawing in detail, where like numerals indicate like elements, there is shown in FIG. 1 a vehicle in accordance with the present invention designated generally as 10. The vehicle 10 includes a body having a pair of support wheels 12 along one side thereof. The wheels 12 ride on a rail 14. On the other side of the vehicle body, there is provided one or more drive wheels 16. As shown in FIG. 3, there are provided a pair of drive wheels 16 coupled together for simulataneous oscillation with their mount relative to the vehicle body. The drive wheels 16 ride on a rail defined by a drive shaft 18. In addition to being a drive shaft, element 18 is a rail for supporting the said other side of the body of the vehicle 10.

The rails for the vehicle 10 are comprised of modules connected end to end and including a substrate 19. Where the modules are coupled to each other, they overlie flanges on a trough 20. Each trough 20 is supported by a pedestal 22 from the ground 23. Each module preferably supports its own motor 24 drivingly coupled to the drive shaft 18. The drive shaft 18 is supported by a bearing mounted on the substrate 19. Rail 14 is mounted on substrate 19.

A traffic control device 26 is likewise mounted on substrate 19. Device 26 includes acceleration and deceleration cam surfaces 30 and 32 as shown more clearly in FIG. 3. Surfaces 30 and 32 are spaced by a dwell portion which is shown in FIG. 3 in contact with a cam follower 28. Cam follower 28 is coupled to the mounts for drive wheels 16. As is well-known to those skilled in the art, cam surface 32 contacts cam follower 28 and pivots the drive wheels and their mount to an accumulation position wherein the axis of rotation of the drive wheels 16 is parallel or substantially parallel to the longitudinal axis of the drive shaft 18.

A horizontal substrate 34 is supported by body portion 36 on the vehicle 10. Substrate 34 is adapted to support a load which is to be tested, inspected, worked on, or the like. Substrate 34 is coupled to the body of the vehicle 10 with a floating mounting. The floating mounting includes fasteners 38 attached to the substrate 34 and extending through a hole 40 in the body portion 36. See FIG. 6. The diameter of hole 40 is substantially greater than the diameter of the juxtaposed portion of the fastener 38. Substrate 34 is preferably provided with a plurality of fasteners 38 with four such fasteners being illustrated in FIG. 2. The relationship between the fasteners 38 and the body portion 36 facilitates adjustment of the substrate 34 in a fore-aft direction, a vertical direction, as well as in a transverse direction.

The substrate 34 is provided on one side with a dual parameter locator designator 42. See FIG. 5. Locator 42, as will be made clear hereinafter, locates the substrate 34 in a pre-determined side-to-side position as well as in a pre-determined vertical position. The other side of the substrate 34 is provided with a single parameter locator 44. Locator 44 is a rectangular plate secured to the bottom surface of substrate 34 and having structure to be described hereinafter. A cam follower 46 is coupled by linkage 48 to the mount for the drive wheels 16. See FIG. 3. Cam follower 46 is adapted to cooperate with a cam at the trailing end of another vehicle in the system to cause the vehicle 10 to accumulate whereby there is no abrupt collision between two adjacent vehicles.

The precision locator includes a pair of frame portions 50, 52 located along the system where it is desired to stop and locate the vehicle body 10 with precision. The tracks and substrate 19 for the vehicle 10 pass between the frame portions 50, 52. See FIGS. 1 and 2. The frame portions 50, 52 are supported by the floor 23 at an elevation which is adjustable by conventional means not shown.

Referring to FIG. 4 in particular, the frame portion 50 includes a vertical wall 59 adjacent which is provided a pneumatic cylinder 54. Cylinder 54 has one end pivotably connected to one end of lever leg 56. Leg 56 is disposed between and secured to a pair of lever legs 58. The legs 56, 58 are pivoted to the vertical wall 59 of frame portion 50 at pivot pin 60. The piston rod associated with cylinder 54 is pivoted to one end of lever leg 62. Lever leg 62 is between and secured to lever legs 64. Legs 62, 64 are pivoted to wall 59 at pivot pin 66. Fluid is supplied and exausted from the cylinder 54 by way of solenoid operated valve 68. Adjustable limit stops 70 are provided on the wall 59 for cooperation with the lever legs 56, 62.

At the free end of the lever legs 58, there is provided a roller 72. Roller 72 is adapted to enter and cooperate with an inverted V-shaped groove 74 on the locator 44. See FIGS. 2 and 4. Along the same side of the substrate 34 but adjacent to trailing edge thereof, there is provided a plate 76. See FIG. 2. As shown in FIG. 4, plate 76 is thinner than plate 74. A roller 78 at the free end of the lever legs 64 rides on the plate 76. When cylinder 54 is activated so as to pivot lever legs 56, 62 to the operative position as shown in FIG. 4, the rollers 72, and 78 are elevated and elevate one side of the substrate 34 by contact with elements 44, 76 on the substrate 34. The amount of such elevation is generally small, such as 0.125 inches (3 mm) or less.

A switch 80 is supported by or adjacent to the trailing end of the speed control device 26. See FIG. 3. Switch 80 controls the solenoid for valve 68. Switch 80 is tripped by member 82 depending downwardly from the body of vehicle 10 approximately at the same time that the vehicle assumes an accumulation position.

Figure 2:
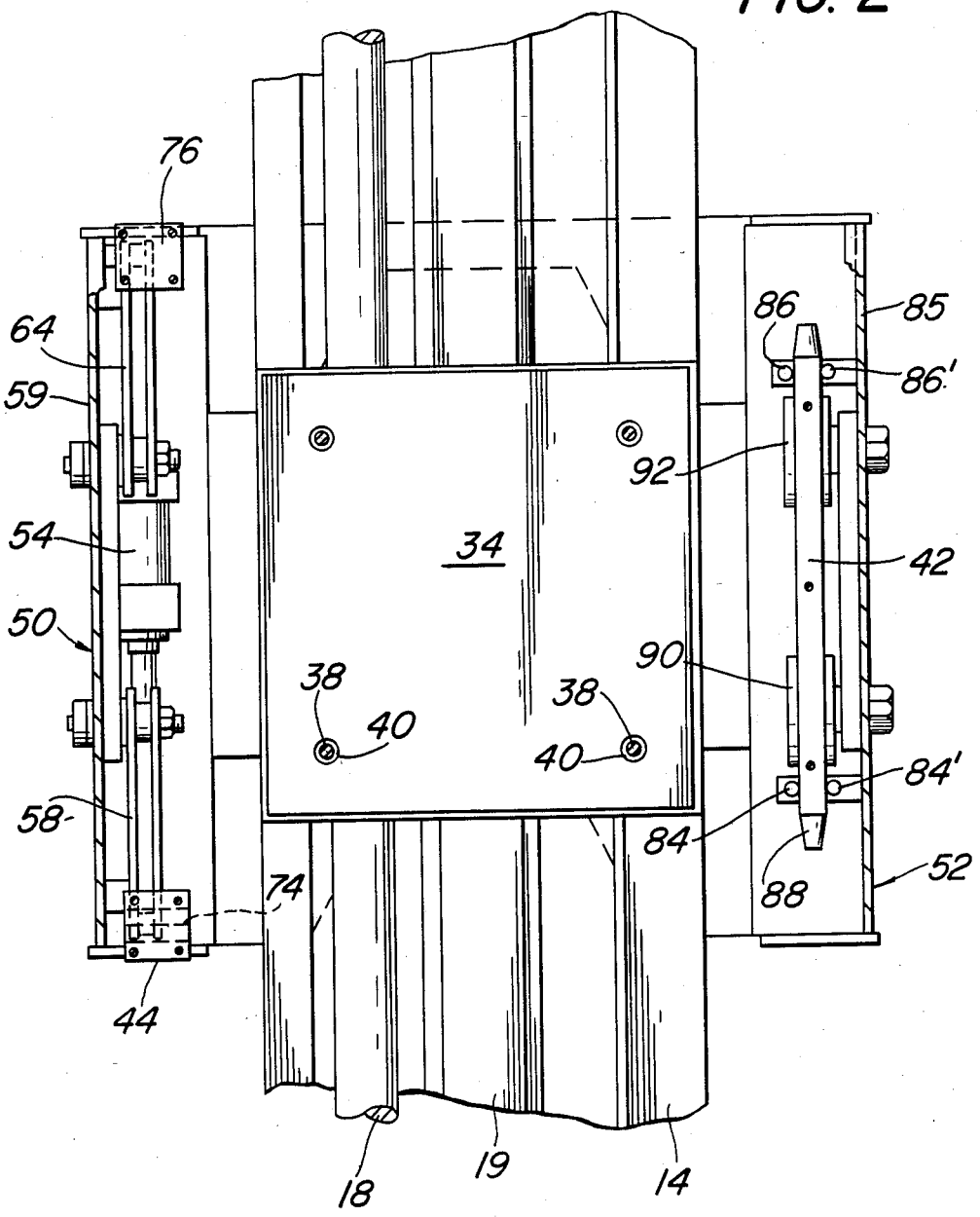
FIG. 2 is a sectional view taken along the line 2—2 in FIG. 1.

Referring to FIGS. 2 and 5, a vertical wall 85 of the frame portion 52 supports a pair of front guides 84 and a pair of rear guides 86. Guides 84 and 86 may be rollers rotatable about vertical axes. Locator 42 on the substrate 34 is preferably provided with a tapered front end 88 and is machined to have a smooth surface. The shape is preferably rectangular. Locator 42 has a length greater than the distance between guides 84, 86. See FIG. 2. Cooperation between locator 42 and guides 84, 86 moves the substrate 34 in a transverse or side to side direction as the vehicle 10 is approaching its accumulation position.

The vertical wall 85 supports a pair of rollers 90, 92. See FIGS. 2 and 5. Rollers 90 and 92 have line contact with the locator 42. Thus, rollers 90, 92 rotate about horizontal axes. Contact between locator 42 and rollers 90, 92 elevates the adjacent side of the substrate 34 to the proper elevation. Thus, rollers 90, 92 elevate one side of the substrate 34 while the rollers 72, 78 elevate the other side of the substrate 34 whereby substrate 34 is horizontal. Fasteners 38 have a lead which is spaced from the bottom surface of body portion 36 so as to facilitate such vertical adjustment.

At this point in time, it will be noted that the substrate 34 has been moved transversely of the rails, has been moved and latched in a fore-aft direction by roller 72, and has been elevated relative to the body of the vehicle 10 by rollers on opposite sides of the rails. At this point in time, the load supported on the substrate 34 may be measured, inspected or worked on by human beings or by robots.

Referring to FIG. 4, it will be noted that micro switch 94 on vertical wall 59 is in contact with lever leg 56. Also, it will be noted that micro switch 96 is spaced from contact with lever leg 62. When switch 94 is tripped, it communicates a signal indicative of the fact that activity with respect to the load on the substrate 34 by a person or robot may commence. When switch 96 is tripped, it communicates a signal to release the speed control device 26 so that the vehicle 10 may move out and accelerate at a speed dictated by cam surface 30. A signal for exausting air from the cylinder 54 is generated manually or by a robot upon completion of the activity with respect to the load supported by substrate 34.

The operation of the present invention is as follows. A load not shown is provided on the substrate 34. The load may be work pieces to be welded, examined, measured, etc. The direction of the vehicle 10 when viewed with the top margin at the right hand side is from right to left in FIGS. 2 and 3. As the vehicle 10 decelerates due to contact between cam follower 28 and cam surface 32, the vehicle 10 enters between the frame sections 50, 52. Precision positioning of substrate 34 in three directions is accomplished substantially simultaneously. The substrate 34 is moved transversely due to contact between locator 42 and the guides 84, 86, 84' and 86'. At the same time, one side edge portion of the substrate 34 is elevated by contact between locator 42 and the rollers 90, 92. As the vehicle 10 reaches its accumulation position, member 82 trips switch 80 to thereby facilitate introduction of air through valve 68 into cylinder 54.

When the cylinder 54 is activated, the lever legs 56, 62 are moved to the operative position shown in FIG. 4. Pivotable movement of legs 56, 62 raises the rollers 72, 78 to thereby elevate the other side of the substrate 34 and locate the substrate 34 at a precise fore-aft location due to cooperation between roller 72 and groove 74. Substrate 34 is now horizontal and has been precisely positioned in three different directions. Switch 94 is tripped to signal that activity with respect to the load by a human being or a robot may commence. When such activity is completed, a signal will be transmitted by the robot or the human being to exhaust the cylinder 54 via valve 68. As the lower end of the lever legs 56, 62 move toward one another, switch 96 is tripped.

Tripping of switch 96 releases the speed control device 26. Device 26 is preferably provided with a pneumatically operated cylinder which reciprocates the device 26 toward the rail 14 to thereby release the vehicle 10. Thereafter, frictional contact between drive shaft 18 and drive wheels 16 propels the vehicle along the rails to the next station. Since only the substrate 34 is orientated in three directions, simple and inexpensive means may be provided to accomplish this result as described above as opposed to means which would be required to move the entire vehicle 10 in three directions.

The present invention may be embodied in other specific forms without departing from the spirit or essential attributes thereof and, accordingly, reference should be made to the appended claims, rather than to the foregoing specification, as indicating the scope of the invention.

We claim:

1. A driverless vehicle comprising a body having support wheels and at least one drive wheel, said drive wheel being adapted for frictional contact with a drive shaft, said body having a load supporting substrate coupled thereto by a floating mount having fasteners which permit limited multi-dimensional movement of the substrate relative to the body, and position locator means on said substrate for cooperation with locator means off the vehicle for positioning said substrate.

2. A vehicle in accordance with claim 1 wherein said mounting for the substrate enables the substrate to move transversely, longitudinally, and vertically with respect to said vehicle body.

3. A vehicle in accordance with claim 1 wherein said substrate includes a fore-aft locator along one side thereof and a second locator on the opposite side thereof for elevating the substrate relative to the body.

4. Apparatus in accordance with claim 3 wherein the second locator on said opposite side of the substrate is arranged to perform the added function of moving the substrate transversely of the body.

5. A vehicle in accordance with claim 3 wherein the fore-aft locator includes a groove for receiving mating structure off the vehicle, said second locator being an elongated member parallel to a side edge of the vehicle.

6. A vehicle in accordance with claim 1 wherein said position locator means on said substrate includes discrete locators on opposite side edge portions of said substrate.

7. A vehicle in accordance with claim 6 wherein said locator means includes a fore-aft locator along one side edge portion of the substrate and an elongated member along the opposite side edge portion of the substrate for performing the dual function of positioning the substrate in vertical and transverse directions relative to said body.

8. A driverless vehicle comprising a body having support wheels and at least one drive wheel, said drive wheel being adapted for frictional contact with a drive shaft, said body having a load supporting substrate coupled to the upper end of said body, fastener means coupling said substrate to said body by a floating mount which permits limited movement of the substrate relative to the body in three mutually perpendiclar directions, said substrate supporting a fore-aft locator along one side edge portion thereof and adapted for cooperation with structure off the vehicle, said substrate on an opposite side edge portion thereof supporting a locator means for cooperation with structure off the vehicle and which is adapted to move the substrate relative to the body in a transverse direction and in a vertical direction.

9. A system comprising a pair of precision locator means carried by frame means adjacent tracks for a driverless vehicle, a driverless vehicle having support wheels on said tracks, means for propelling said vehicle along said tracks, a load supporting substrate coupled to the vehicle by a floating mount having fasteners which permit limited three dimensional movement of said substrate relative to said vehicle, individual ones of said pair of precision locator means being adapted for contact with opposite side edge portions of said substrate, and means for causing the vehicle to move to an accumulation position when a vehicle is adjacent said frame means and thereafter through the intermediation of said pair of precision locator means to precisely position said substrate in three dimensions.

10. A system in accordance with claim 9 wherein each precision locator means has means thereon for elevating a discrete side edge portion of the substrate.

11. A system in accordance with claim 10 wherein the last mentioned means on the precision locator means includes a pair of spaced rollers rotatable about horizontal axes spaced from one another by a distance less than the front to rear dimension of the substrate.

12. A system in accordance with claim 10 wherein each of said precision locator means for elevating a discrete side edge portion of the substrate includes a pair of rollers rotatable about horizontal axes spaced from one another by a dimension less than the front to rear dimension of the substrate, the rollers on one of said elevating means being vertically movable, motor means for vertically moving said movable rollers, and the rollers on the other of said means having axes of rotation which remain stationary.

13. A system in accordance with claim 12 wherein said substrate has a groove for receiving said moveable rollers, said substrate having an elongated locator extending longitudinally for contact with said stationary rollers.

14. A system in accordance with claim 13 including guides on said frame means for shifting said substrate in a transverse direction due to contact with said elongated locator.

15. A system in accordance with claim 13 wherein said locator is rectangular in section.

* * * * *